US007819989B2

(12) United States Patent
Ishikura et al.

(10) Patent No.: US 7,819,989 B2
(45) Date of Patent: Oct. 26, 2010

(54) SURFACE TREATING SOLUTION FOR SURFACE TREATMENT OF ALUMINUM OR MAGNESIUM METAL AND A METHOD FOR SURFACE TREATMENT

(75) Inventors: Kazuhiro Ishikura, Tokyo (JP); Michiro Kurosawa, Tokyo (JP); Takaomi Nakayama, Totyo (JP); Hiroyuki Sato, Totyo (JP); Tadashi Matsushita, Totyo (JP); Eisaku Okada, Toyota (JP); Fumiya Yoshida, Ikeda (JP); Katsuhiro Shiota, Ikeda (JP)

(73) Assignees: Nihon Parkerizing Co., Ltd., Tokyo (JP); Toyota Jidosha Kabushiki Kaisha, Toyota-shi (JP)

( * ) Notice: Subject to any disclaimer, the term of this patent is extended or adjusted under 35 U.S.C. 154(b) by 661 days.

(21) Appl. No.: 10/505,640

(22) PCT Filed: Jun. 12, 2002

(86) PCT No.: PCT/JP02/05861

§ 371 (c)(1),
(2), (4) Date: Aug. 19, 2004

(87) PCT Pub. No.: WO03/074761

PCT Pub. Date: Sep. 12, 2003

(65) Prior Publication Data

US 2005/0067057 A1 Mar. 31, 2005

(30) Foreign Application Priority Data

Mar. 5, 2002 (JP) ..... 2002-059041
Mar. 5, 2002 (JP) ..... 2002-059042

(51) Int. Cl.

| | |
|---|---|
| ***C23C 10/00*** | (2006.01) |
| ***C23C 22/48*** | (2006.01) |
| ***C23C 22/56*** | (2006.01) |
| ***C23C 22/57*** | (2006.01) |
| ***C23C 22/00*** | (2006.01) |
| *C04B 9/02* | (2006.01) |

(52) U.S. Cl. ..... 148/273; 148/243; 148/247; 148/275; 106/14.05; 106/14.11; 106/14.21

(58) Field of Classification Search ..... 148/240–287; 106/14.05, 14.11, 14.12, 14.21
See application file for complete search history.

(56) References Cited

U.S. PATENT DOCUMENTS

| | | | | |
|---|---|---|---|---|
| 3,682,713 | A * | 8/1972 | Ries et al. | 148/247 |
| 4,191,596 | A | 3/1980 | Dollman et al. | |
| 4,273,592 | A | 6/1981 | Kelly | |
| 4,313,769 | A | 2/1982 | Frelin et al. | |
| 5,380,374 | A | 1/1995 | Tomlinson | |
| 5,449,415 | A | 9/1995 | Dolan | |
| 5,797,987 | A * | 8/1998 | Rossio | 106/14.12 |
| 6,083,309 | A | 7/2000 | Tomlinson | |
| 6,419,731 | B2 * | 7/2002 | Inbe et al. | 106/14.44 |
| 6,749,694 | B2 * | 6/2004 | Greene et al. | 148/243 |
| 6,758,916 | B1 * | 7/2004 | McCormick | 148/251 |

FOREIGN PATENT DOCUMENTS

| | | |
|---|---|---|
| JP | 56-136978 | 10/1981 |
| JP | 57-94575 | 6/1982 |
| JP | 03-191071 | 8/1991 |
| JP | 03-240972 | 10/1991 |
| JP | 05-222321 | 8/1993 |
| JP | 06-330341 | 11/1994 |
| JP | 08-134662 | 5/1996 |
| JP | 09-025436 | 1/1997 |
| JP | 2000-199077 | 7/2000 |
| JP | 2003-573199 | 9/2006 |
| WO | WO 85/05131 | * 11/1985 |
| WO | WO 95/14539 | 6/1995 |
| WO | WO 96/21752 | 7/1996 |

* cited by examiner

*Primary Examiner*—Roy King
*Assistant Examiner*—Caitlin Fogarty
(74) *Attorney, Agent, or Firm*—Flynn, Thiel, Boutell & Tanis, P.C.

(57) ABSTRACT

A composition for surface treatment of aluminium, aluminum alloys, magnesium or magnesium alloys and the treating solutions being diluted to the desired concentration are defined. The composition contains (1) compound A containing at least one metal element selected from the group consisting of Hf(IV), Ti(IV) and Zr(IV), (2) a fluorine-containing compound of sufficient amount to make fluorine exist in the composition in an amount of at least 5 times the molarity of the total molarity of the metal contained in the above-mentioned compound A, (3) at least one metal ion B selected from the group of alkaline earth metals, (4) at least one metal ion C selected from the group consisting of Al, Zn, Mg, Mn and Cu, and (5) nitric ion and the mol concentration of compound A is 0.1-50 mmol/L as the metal element of Hf(IV), Ti(IV) and Zr(IV). A metal treated with the treating method of the present invention solution has an excellent resistance to various corrosive environments.

11 Claims, No Drawings

SURFACE TREATING SOLUTION FOR SURFACE TREATMENT OF ALUMINUM OR MAGNESIUM METAL AND A METHOD FOR SURFACE TREATMENT

FIELD OF THE INVENTION

The present invention relates to a composition for surface treatment used for the purpose of depositing a surface treated film having a good resistance against a corrosive environment to metals, such as aluminum or aluminum alloy and magnesium or magnesium alloys, in which these metals are used without coating or a better resistance to a corrosive environment not discharging a waste, e.g., hexavalent chrome, a treating solution for surface treatment and a method for surface treatment. The present invention further relates to a treated metal material which has excellent corrosion resistance to various environments.

DESCRIPTION OF THE PRIOR ART

Aluminum and aluminum alloys are applied increasingly in the field of the car parts industry to lighten a car. For example, for a cylinder head cover, cylinder head, crank case and timing gear case, which are the parts connecting with the engine, an aluminum alloy die cast e.g. ADC10 or ADC12 are used and 5000 alloy or 6000 alloys are used. Currently, magnesium and magnesium alloys are also used from the same view point.

Furthermore, aluminum, aluminum alloys, magnesium and magnesium alloys are applied in other fields than car bodies and the conditions of use for these metals and metal alloys are variable, namely, sometimes used with a coating after being molded and sometimes used without a coating. Therefore, the functions necessary for surface treatment are variable, and functions which meet the exposing atmosphere, for example, adhesion or corrosion resistance of uncoated metal and corrosion resistance after being coated are required.

As the surface treatment to be performed on aluminum, aluminum alloys, magnesium and magnesium alloys, a chromate treatment using hexavalent chrome is popular. The chromate treatments can be classified into two types, one which contains hexavalent chrome in a film and the other one does not contain hexavalent chrome in a film. However, both treatments contain hexavalent chrome in the waste solution. Therefore, this chromate method is not so desired from the view point of environmental regulation.

As a surface treating method not using hexavalent chrome, a zinc phosphate treatment is known. For the purpose of depositing a zinc phosphate film on the surface of aluminum, an aluminum alloy, magnesium and a magnesium alloy, various inventions have been proposed. For example, in JP6-99815 publication, a method of depositing a zinc phosphate film, which has an excellent corrosion resistance, especially scab corrosion resistance after cathodic electrodeposition coating, is proposed. This method is characterized by regulating the concentration of fluorine in a zinc phosphate film treating solution and, further, by regulating the molar ratio of complex fluoride to fluorine and the concentration of activated fluorine measured by a silicon electrode meter into a specific limitation.

Further, in JP3-240972A Laid Open Publication, the method of forming a zinc phosphate film, which excels in corrosion resistance and especially in scabbing resistance after cathodic electrodeposition coating is proposed. This method is characterized by regulating the concentration of fluorine, keeping the lower limit of the molar ratio of complex fluoride to fluorine and using a zinc phosphate treating solution in which the activated fluorine concentration measured by a silicon electrode meter is kept within a specific limitation. Adding to this operation, aluminum ion is precipitated from said zinc phosphate treating solution by adding fluorine after said zinc phosphate treating solution is introduced in the outside of a zinc phosphate treating bath.

These methods aim to improve the zinc phosphate treatment ability to an aluminum alloy by increasing the fluorine ion concentration in the zinc phosphate treating solution. However, it is difficult to obtain good corrosion resistance of an uncoated metal by a zinc phosphate film. Further, since aluminum ion dissolved out at the zinc phosphate treatment causes an increase of the waste product by forming a sludge.

JP6-330341A Laid Open publication discloses a zinc phosphate treating method for magnesium alloy. This method is characterized by containing a specific concentration of zinc ion, manganese ion, phosphate ion, fluoride and an accelerator for film depositing and by keeping the upper limits of concentration of nickel ion, cobalt ion and copper ion. Further, in JP8-134662A Laid Open publication, a method of removing the settled out magnesium ion by adding fluorine to the zinc phosphate treating solution for magnesium is shown.

The above-mentioned methods both aim at the substrate treatment for coating, therefore, it is difficult to obtain sufficient corrosion resistance of uncoated metals by a zinc phosphate film. Furthermore, as shown in JP8-134662A Laid Open publication, the generation of sludge cannot be avoided as long as a zinc phosphate treatment is used. The method of forming a surface-treated film having a good adhesion and corrosion resistance after coating without containing hexavalent chrome in the treating solution, except for the zinc phosphate treatment, the surface-treating solution for aluminum or aluminum alloy containing a vanadium compound is disclosed in JP56-136978A Laid Open publication. This method is desired in obtaining a surface-treated film which is relatively excessive in providing corrosion resistance to an uncoated metal, however, the metal to be treated is only an aluminum alloy alone and, further, it is necessary to have a high temperature condition of 80° C. to obtain a surface treated film.

In JP5-222321A Laid Open publication, an aqueous composition for treatment before coating for an aluminum or aluminum alloy containing a water-soluble poly(metha) acrylic acid, or salts thereof, and at least one, or more than two, water-soluble compound of a metal selected from the group consisting of Al, Sn, Co, La, Ce and Ta is disclosed. In JP9-25436A Laid Open publication, the surface treating composition for an aluminum alloy containing an organic polymer compound which contains at least one nitrogen atom or salt thereof, a heavy metal or salt thereof, which is water-soluble, water-dispersible or emulsifiable is disclosed. These compositions are limitingly used for the surface treatment of an aluminum alloy and their performance in providing corrosion resistance to an uncoated metal is not desirable.

Further, JP2000-199077 Laid Open publication shows a surface-treating composition, a treating solution for surface treatment and a surface treating method for a metal surface of aluminum, magnesium or zinc composed of at least one compound selected from the group consisting of a metal acetylacetonate, water-soluble inorganic titanium compound and water-soluble inorganic zirconium compound. According to this method, it is possible to form a surface-treated film having a good corrosion resistance on uncoated metals. However, in said solution for the surface treating of the mentioned invention, an organic compound is used and this organic compound can be an obstacle for establishing a closed system of a water rinsing process after the film depositing treatment process.

As mentioned above, the conventional art do not make it possible to form a surface-treated film which provides excellent corrosion resistance after being coated on the surface of aluminum, an aluminum alloy, magnesium or a magnesium alloy, using a treating solution which does not discharge a waste such as sludge and does not contain harmful components to the environment.

DISCLOSURE OF THE INVENTION

The object of the present invention is to provide a composition for surface treatment, a treating solution for surface treatment and a surface treating method which aim to form a surface-treated film which excels in corrosion resistance of an uncoated metal and corrosion resistance after being coated on the surface of aluminum, an aluminum alloy, magnesium or a magnesium alloy using a treating solution which does not discharge a waste such as a sludge and does not contain harmful components to the environment such as hexavalent chrome. Further, another object of the present invention is to provide said metal materials which excel in corrosion resistance of uncoated metal and corrosion resistance after being coated.

The present invention is a composition for surface treatment of aluminum, an aluminum alloy, magnesium or a magnesium alloy comprising components (1)-(5);

(1) compound A containing at least one metal element selected from the group consisting of Hf(IV), Ti(IV) and Zr(IV), (2) fluorine-containing compound of a sufficient amount to make fluorine exist in the composition in an amount of at least 5 times the molarity of the total molarity of the metal contained in the above-mentioned compound A, (3) at least one metal ion B selected from the group of alkaline earth metals, (4) at least one metal ion C selected from the group consisting of Al, Zn, Mg, Mn and Cu, and (5) nitric ion.

Further, the present invention is a treating solution for the surface treatment of aluminum, an aluminum alloy, magnesium or a magnesium alloy comprising components (1)-(5);

(1) 0.1 to 50 mmol/L of compound A containing at least one metal element selected from the group consisting of Hf(IV), Ti(IV) and Zr(IV as said metal element, (2) fluorine-containing compound of sufficient amount to provide fluorine in the treating solution in an amount of at least 5 times the molarity of the total molarity of the metal contained in above-mentioned compound A, (3) at least one metal ion B selected from the group of alkaline earth metals, (4) at least one metal ion C selected from the group consisting of Al, Zn, Mg, Mn and Cu, and (5) nitric ion.

In the above-mentioned treating solution for metal surface treatment, the desirable total concentration of alkaline earth metal ion B is from 1 to 500 ppm and the desirable concentration of metal ion C is from 1 to 5000 ppm. Further, the desirable concentration of nitric ion is from 1000 to 30000 ppm. To the above-mentioned treating solution for metal surface treatment, can further be added at least one compound selected from the group consisting of $HClO_3$, $HBrO_3$, $HNO_2$, $HMnO_4$, $HVO_3$, $H_2O_2$, $H_2WO_4$, $H_2MoO_4$ and an oxygen acid salt thereof. The desirable pH of the treating solution for metal surface treatment is from 3 to 6.

Moreover, the present invention provides a method for metal surface treatment by contacting aluminum, an aluminum alloy, magnesium or a magnesium alloy with the above-mentioned treating solution for metal surface treatment. Further, the present invention provides a method for metal surface treatment by contacting a metal material containing at least one metal selected from the group consisting of aluminum, an aluminum alloy, magnesium or a magnesium alloy as a component with the above-mentioned treating solution for metal surface treatment. Furthermore, the present invention provides a surface-treated metal material possesses a surface-treated film layer obtained by the above-mentioned method for metal surface treatment on the surface of aluminum, an aluminum alloy, magnesium or a magnesium alloy, wherein the coating amount of said surface-treated film layer is larger than 10 $mg/m^2$ as the metal element contained in the above-mentioned compound A.

DESCRIPTION OF THE PREFERRED EMBODIMENT

The present invention relates to the surface treatment of aluminum, an aluminum alloy, magnesium or a magnesium alloy, and this surface treatment can be applied to the metal material combining at least two kinds of aluminum, aluminum alloys, magnesium or magnesium alloy and further can be applied to a metal material combining at least one metal selected from the group consisting of aluminum, an aluminum alloy, magnesium or a magnesium alloy with a steel- or a zinc-plated steel. This surface treatment is useful for the previous treatment for coating of a car body composed of these metal materials.

The composition for metal surface treatment of the present invention is a composition containing (1) compound A containing at least one metal element selected from the group consisting of Hf(IV), Ti(IV) and Zr(IV), (2) a fluorine-containing compound of a sufficient amount to provide fluorine in the composition in an amount of at least 5 times the molarity of the total molarity of the metal contained in the above-mentioned compound A, (3) at least one metal ion B selected from the group of alkaline earth metals, (4) at least one metal ion C selected from the group consisting of Al, Zn, Mg, Mn and Cu and (5) nitric ion.

As the compound A containing at least one metal element selected from the group consisting of Hf(IV), Ti(IV) and Zr(IV) (hereinafter shortened to compound A), for example, $HfCl_4$, $Hf(SO_4)_2$, $H_2HfF_6$, salts of $H_2HfF_6$, $HfO_2$, $HfF_4$, $TiCl_4$, $Ti(SO_4)_2$, $Ti(NO_3)_4$, $H_2TiF_6$, salts of $H_2TiF_6$, $TiO_2$, $TiF_4$, $ZrCl_4$, $Zr(SO_4)_2$, $Zr(NO_3)_4$, $H_2ZrF_6$, salts of $H_2ZrF_6$, $ZrO_2$ and $ZrF_4$ are available. These compounds can be used in combination.

As the fluorine-containing compound of the component (2) of the present invention, hydrofluoric acid, $H_2HfF_6$, $HfF_4$, $H_2TiF_6$, TiF4, $H_2ZrF_6$, $ZrF_4$, $HBF_4$, $NaHF_2$, $KHF_2$, $NH_4HF_2$, NaF, KF and $NH_4F$ are available. These fluorine-containing compounds can be used in combination.

As at least one metal ion B selected from the group of alkaline earth metals of the component (3) (hereinafter shortened to alkaline earth metal B) is an element belonging to the $2^{nd}$ group of periodic law list, except for Be and Ra, desirably Ca, Sr or Ba. In general, although elements belonging to the $2^{nd}$ group of periodic law list are called alkaline earth metals, the property of Be is different from that of the other alkaline earth metals and since Be and Be compounds have a strong toxicity, these are outside of the object of the present invention that does not contain a harmful component to the environment. While, Ra is a radioactive element and, concerning it's troublesome handling, the industrial use of Ra is not so practical. Therefore, in the present invention, elements belonging to $2^{nd}$ group of periodic law list except Be and Ra are used. As the supply source of alkaline earth metal ion B, oxides, hydroxides, chlorides, sulfates, nitrates and carbonates of said metals can be mentioned and are available.

Metal ion C of the component (4) used in the present invention is at least one metal ion selected from the group consisting of Al, Zn, Mg, Mn and Cu (hereinafter shortened simply to metal ion C). As the supplying source of metal ion C, for example, oxides, hydroxides, chlorides, sulfates, nitrates and carbonates of said metals can be mentioned. Further, as the supplying source of nitric ion of the component (5) of the present invention, nitric acid or nitrates can be used.

Practically, the composition for metal surface treatment mentioned above is diluted by water to the treating solution for metal surface treatment. This treating solution for metal surface treatment of the present invention contains at least one metal element selected from the group consisting of Hf(IV), Ti(IV) and Zr(IV) in a total molar concentration of 0.1-50 mmol/L, desirably 0.2-20 mmol/L. Said metal element which is supplied from compound A in the present invention is the main component of a surface-treated film. Therefore, when the total molar concentration of said metal element is smaller than 0.1 mmol/L, the concentration of the main component of the surface-treated film becomes small and enough thickness of the film to provide sufficient corrosion resistance of the uncoated metal and corrosion resistance after being coated cannot be obtained by a short treatment time. When the total molar concentration of said metal element is larger than 50 mmol/L, although the surface-treated film can be deposited sufficiently, the ability of the corrosion resistance cannot be increased and it is disadvantageous as is expected and it is not advantageous from the economical view point.

The concentration of fluorine in the fluorine-containing treating solution for surface treatment of a metal is at least 5 times the molarity of the total molarity of the metal contained in the above-mentioned compound A. Desirably, at least 6 times the total molarity of the above-mentioned metal. The fluorine concentration is adjusted by regulating the amount of the fluorine-containing compound of the component (2).

The fluorine component of the fluorine containing compound of the present invention has following two functions. The first one is to maintain metal elements contained in compound A of the treating solution stable in the condition of a treating bath. The second one is to etch the surface of aluminum, an aluminum alloy, magnesium or a magnesium alloy and to maintain aluminum ions or magnesium ions dissolved out into the treating solution for surface treatment stable in the treating bath.

To initiate the etching reaction of the aluminum, aluminum alloy, magnesium or magnesium alloy by fluorine, it is necessary that the fluorine concentration is at least 5 times the total molarity of the metal elements contained in compound A. If the fluorine concentration is smaller than 5 times the total molarity of the metal elements contained in compound A, the fluorine in the treating solution for surface treatment is only used to maintain the stability of the metal elements contained in compound A and a sufficient etching amount cannot be obtained. Further, since the pH to form the oxide of the above-mentioned metal elements on the metal surface to be treated cannot be achieved, a coating amount sufficient to perform the corrosion resistance cannot be obtained.

In the case of a zinc phosphate treatment, which is the conventional art, sludge is generated from the process because, for example, aluminum ions dissolved out from aluminum alloy forms an insoluble salt with phosphoric acid and fluorine and sodium ions form an insoluble salt called cliorite. On the other hand, when the treating solution for surface treatment of the present invention is used, sludge is not generated due to the solubilizing effect of the fluorine. Further, when the treating amount of the metal material to be treated is remarkably large to the capacity of the treating bath, for the purpose of solubilizing the dissolved out metal material component to be treated, an inorganic acid such as sulfuric acid, hydrochloric acid or an organic acid such as acetic acid, oxalic acid, tartaric acid, citric acid, succinic acid, gluconic acid or phthalic acid or a chelating agent which chelates the metal material component to be treated can be added. These compounds can be used together.

The metal elements provided by the compound A can exist stably in an acidic aqueous solution, however, in an alkaline aqueous solution, said metal elements form an oxide of each metal element. Along with the etching reaction by fluorine of the metal material to be treated, the pH is elevated at the surface of the metal material to be treated and the above-mentioned metal elements form an oxide on the metal surface to be treated. Namely, an oxide film of these metal elements is formed and the performance of the corrosion resistance is enhanced.

The component (1) and the component (2) in a composition for metal surface treatment or a treating solution for metal surface treatment display the above-mentioned function and form an oxide film of the metal elements supplied from compound A on the surface of the metal material. To these components, at least one kind of metal ion B selected from the group consisting of alkaline earth metals of the component (3), at least one kind of metal ion C selected from the group consisting of Al, Zn, Mg, Mn and Cu of the component (4) and nitric ion of component (C) are further blended.

Generally, alkaline earth metals reacts with fluorine to form fluorides. Alkaline earth metal ion B in the treating solution for surface treatment of this invention generates fluoride and consumes fluorine in the treating solution for surface treatment. Along with the consumption of the fluorine mentioned above, the stability of the metal element supplied from the compound A decreases. Therefore, the pH value which allows the formation of an oxide consisting of the main component of the film becomes lower and it makes possible to lower the surface treatment temperature and shorten the treatment time. The desirable concentration of the metal ion in the solution for the metal surface treatment is 1-500 ppm and a more desirable concentration is 3-100 ppm. When the concentration is lower than 1 ppm, the above-mentioned effect to accelerate the reaction for depositing the film cannot be obtained. On the other hand, when the concentration is larger than 500 ppm, a film of a sufficient amount to provide a good resistance to corrosion can be obtained, however, the stability of the treating bath is spoiled. Therefore, a problem which obstructs the continuous operation is caused.

Ordinarily, the fluoride of the alkaline earth metal is a compound which is hard to dissolve. One of the objects of this invention is not to generate a sludge. By further blending the metal ion C of the component (4) and the nitric ion of the component (5) in the treating solution for metal surface treatment of the present invention, the above-mentioned fluoride of alkaline earth metal ion B can be solubilized and the generation of sludge can be controlled. Consequently, the reaction for film formation is accelerated and the corrosion resistance of the uncoated surface can be improved.

Metal ion C is an element which generates a complex fluoride. Therefore, metal ion C has the effect of consuming fluorine in the treating bath and to accelerate the reaction to form the treated film as well as alkaline earth metal ion B generates fluoride and consumes fluorine. Further, metal ion C has a function of solubilizing alkaline earth metal ion B. Metal ion C makes the fluoride of alkaline earth metal ion B solubilize by generating a complex fluoride with fluorine. Furthermore, the solubility of alkaline earth metal ion B is increased by adding a nitric ion. That is, by the present invention, it becomes possible to accelerate the reaction for film formation maintaining the stability of the surface treating solution by adding the alkaline earth metal ion B, metal ion C and nitric ion.

The solubilizing reaction of the alkaline earth metal ion B by metal ion C is illustrated as follows using the example of Ca and Al as follows.

$$CaF_2+2Al^{3+}=Ca^{2+}+2AlF^{2+}$$

Still further, metal ion C has a function of improving the corrosion resistance of an uncoated metal. At the present time, the mechanism of the improvement of the corrosion resistance of metal ion C is not clear. However, the inventors have conducted intensive studies about the relationship between the metal to be added to the treated film formed by using compound A and the corrosion resistance of an uncoated metal, and has found out that the corrosion resistance of the uncoated metal can be remarkably improved by adding a specific metal ion, namely metal ion C. The desirable concentration of metal ion C in the treating solution for metal surface treatment is 1-5000 ppm and a more desirable concentration is 1-3000 ppm. When the concentration is smaller than 1 ppm, the above-mentioned effect to accelerate the reaction for film formation cannot be obtained and the function of solubilizing the fluoride of the alkaline earth metal cannot be obtained. When the concentration is larger than 5000 ppm, although a formed film having a sufficient amount to obtain a good resistance to corrosion can be obtained, the further improving of the corrosion resistance cannot be expected and it is only disadvantageous economically.

Even if the concentration of nitric ion is smaller than 1000 ppm, it is possible to form the treatment film of uncoated metals having a good resistance to corrosion. However, as a large amount of alkaline earth metal ion B makes the treatment solution in a bath unstable, the nitric ion concentration is larger than this value. As the above-mentioned result, it is concluded that the desired concentration of nitric ion becomes 1000 ppm-30000 ppm. Now, the reactivity of the treating solution to a metal surface can be easily surveyed by measuring the concentration of free fluorine ion.

Inventors conducted the measuring of concentration of fluorine ion in the treating solution to determine the desirable concentration of free fluorine ion is smaller than 500 ppm and more desirably is smaller than 300 ppm. When the concentration of free fluorine ion is larger than 500 ppm, it becomes hard to form a film in enough of an amount to provide good corrosion resistance to uncoated or coated metals. These materials act as an oxidant and accelerate the above-mentioned film formation reaction. In the case that these materials are used as an oxidant, sufficient effect is obtained by an adding amount of 50-5000 ppm. On the other hand, a higher concentration of these materials are needed as an etching reagent.

To the treating solution for metal surface treatment of the present invention, at least one compound selected from the group consisting of $HClO_3$, $HBrO_3$, $HNO_2$, $HMnO_4$, $HVO_3$, $H_2O_2$, $H_2WO_4$, $H_2MoO_4$ and salts of these oxygen acids can be added. At least one compound selected from the group consisting of the above-mentioned oxygen acid, and salts thereof, acts as an oxidant and accelerates the film-forming reaction of the present invention. There is no limitation to the concentration of the above-mentioned oxygen acids, and salts thereof, to be added, however, when these are used as an oxidant, a sufficient effect is provided by the adding amount of 10-5000 ppm. Further, when the above-mentioned oxygen acids and salts thereof also act as the acid to maintain the etched metal material component in the treating bath, the adding amount can be increased if necessary.

The pH of the solution for metal surface treatment of the present invention is desirably 3-6. When the pH is lower than 3, the metal element supplied from compound A becomes stable in the solution for surface treating and it becomes impossible to form enough of a film to provide good corrosion resistance in a short treatment time. Further, when the pH is higher than 6, it is possible to form enough of the film to obtain a good resistance to corrosion, however, a film which has a good corrosion resistance is not easily obtained because the treating solution becomes unstable under this pH condition.

In the present invention, the surface-treated film layer can be formed on the surface of the aluminum, aluminum alloy, magnesium or magnesium alloy by contacting the aluminum, aluminum alloy, magnesium or magnesium alloy with the above-mentioned treating solution for metal surface treatment. The desired methods are a spraying method, roll coating method or dipping method. At contact, it is desirable to set the temperature of the treating solution for surface treatment to 30-70° C. If the treating temperature is lower than 30° C., the film formation needs a longer time than a conventional treatment, such as a zinc phosphate treatment or chromate treatment. As the zinc phosphate treatment time is two minutes or the chromate treatment time is about one minute, a longer treatment time than that of these treatments is not practical. On the other hand, when the temperature is higher than 70° C., it is not economically advantageous because a remarkable time decreasing effect is not obtained.

Generally, it is difficult to form uniform films on the objects composed from various kind of metals, for example, a car body which is composed from steel, zinc-plated, an aluminum alloy or a magnesium alloy, because the less noble metal dissolves preferably to the noble metal. It is very difficult to form a uniform film on the surface of both metal surfaces. The present invention proposes countermeasure to this problem. By the method of the present invention, which dips the subject into the treating solution for metal surface treatment, alkaline earth metal ion B reacts with fluorine and generates fluoride and by said consumption of fluorine in the composition, the stability of the metal element of compound A in the treating bath is spoiled, therefore, the pH value which forms these oxides drops. As mentioned above, since the present invention is to accelerate the film-depositing reaction by adding alkaline earth metal ion B, it becomes possible to form a sufficient amount of film enough to obtain the corrosion resistance on the surface metal material, such as a car body, characterized that the different metals are connected.

The depositing amount of the surface-treated film layer to the metal material to be treated of the present invention is necessary to be larger than 10 mg/m$^2$ as the total amount of at least one metal element selected from the group consisting of Hf(IV), Ti(IV) and Zr(IV). In the case that the depositing amount is smaller than 10 mg/m$^2$, whether the treated metal with the coating has a good corrosion resistance or not depends on the surface condition or the components of the alloys and 10 $mg/m^2$ is the threshold value to keep an excellent film.

EXAMPLE

Performance of the composition for surface treatment, the treating solution for surface treatment and the method for surface treatment of the present invention will be explained in accordance to the Examples and Comparative Examples. The treated materials, a degreasing agent and a coated material other than the treating solutions of this invention are selected among the commercial materials, and in the practical treating process before coating, it is not restricted within these materials.

Test Plate

The abbreviation marks and details of the test plates used in Examples and Comparative Examples are shown as follows.

ADC: (aluminum diecast: ADC12)

Al: (aluminum alloy plate: 6000 type aluminum alloy)

Mg: (magnesium alloy plate: JIS-H-4201)

Treating Process

Examples and Comparative Examples except zinc phosphate treatment are treated by the following procedure.

alkali degreasing→rinsing by water→film-forming treatment→rinsing by water→rinsing by pure water→drying Zinc phosphate treatment in Comparative Example is treated by the following procedure.

alkali degreasing→rinsing by water→surface conditioning→zinc phosphate treatment→rinsing by water→rinsing by pure water→drying In the Examples and Comparative Examples, the alkali degreasing is carried out as follows. That is, FINE CLEANER 315 (T.M.: Product of NIHON PAKERIZING CO., LTD.) is diluted to a 2% concentration by tap water and this diluted solution is sprayed onto a plate at 50° C. for 120 sec.

The rinsing process by water and the rinsing process by pure water after the film treatment process in the Examples and Comparative Examples are as follows; spraying water or pure water onto a plate at room temperature for 30 sec.

Example 1

The composition for surface treatment is prepared with an aqueous solution of titanium sulfate (IV) and hydrofluoric acid. The molarity ratio of Ti to HF in the composition is 7.0 and the Ti concentration is 100 mmol/L. Then, $Ca(NO_3)_2$ reagent and $ZnSO_4$ reagent and $HNO_3$ are added and the composition for surface treatment is prepared. The prepared composition is diluted by water and the obtained treating solution for surface treatment has a Ti concentration of 50 mmol/L, Ca concentration of 2 ppm, Zn concentration of 1000 ppm and $HNO_3$ concentration of 1000 ppm. After degreasing, a test plate is rinsed by water and kept in said treating solution adjusted to a pH of 4.0 using an ammonium aqueous solution, at a temperature of 30° C. for 180 sec.

Example 2

The composition for surface treatment is prepared with an aqueous solution of hexafluorotitanic acid (IV) and hydrofluoric acid. The molarity ratio of Ti to HF in the composition is 8.0 and the Ti concentration is 40 mmol/L. Then $Ba(NO_3)_2$ reagent, $Al(OH)_3$ reagent, $HBrO_3$ reagent and $HNO_3$ are added, and the composition for surface treatment is prepared.

The prepared composition is diluted by water and the treating solution for surface treatment has a Ti concentration of 20 mmol/L, Ba concentration of 500 ppm, Al concentration of 20 ppm, $HNO_3$ concentration of 3000 ppm and $HBrO_3$ concentration of 500 ppm.

After being degreased, a test plate is rinsed by water and kept in said treating solution adjusted to a pH of 4.0 using NaOH, at the temperature of 30° C. for 180 sec.

Example 3

The composition for surface treatment is prepared with an aqueous solution of hafnium oxide (IV) and hydrofluoric acid. The molarity ratio of Hf to HF in the composition is 10.0 and the Hf concentration is 30 mmol/L. Then $CaSO_4$ reagent, $Mg(NO_3)_2$ reagent and $HNO_3$ are added and the composition for surface treatment is prepared.

The prepared composition is diluted by water and the treating solution for surface treatment has a Hf concentration of 10 m mol/L, Ca concentration of 500 ppm, Mg concentration of 250 ppm, $HNO_2$ concentration of 100 ppm and $HNO_3$ concentration of 1500 ppm.

After degreasing, a test plate is rinsed by water and kept in said treating solution adjusted to a pH of 5.0 using an ammonium aqueous solution, at the temperature of 50° C. for 60 sec.

Example 4

The composition for surface treatment is prepared by mixing an aqueous solution of hexafluorozirconic acid (IV) with an aqueous solution of hafnium sulfonate (IV) so that the weight ratio of Zr to Hf was Zr:Hf=2:1, and hydrofluoric acid. The total molarity ratio of Zr and Hf to HF in the composition is 12.0 and total Zr and Hf concentration is 10.0 mmol/L.

This composition is diluted by water, then $Sr(NO_3)_2$ reagent, $Mg(NO_3)_2$ reagent, $Mn(NO_3)_2$ reagent, $ZnCO_3$ reagent, $HClO_3$ reagent, $H_2WO_4$ reagent and $HNO_3$ are added, and the treating solution for surface treatment has total concentration of Zr and Hf of 2 mmol/L, Sr concentration of 100 ppm, Mg concentration of 50 ppm, Mn concentration of 100 ppm, Zn concentration of 50 ppm, $HClO_3$ concentration of 150 ppm, $H_2WO_4$ concentration of 50 ppm and $HNO_3$ concentration of 8000 ppm.

After degreasing, a test plate is rinsed by water and said treating solution of the temperature is 45° C., whose pH is adjusted to 6.0 using KOH, is sprayed onto the test plate and the surface treatment is carried out for 90 sec.

Example 5

The composition for surface treatment is prepared with an aqueous solution of zirconium nitrate (IV) and $NH_4F$ reagent. The molarity ratio of Zr to HF in the composition is 6.0 and the Zr concentration is 10 mmol/L. Then, $CaSO_4$ reagent, $Cu(NO_3)_2$ reagent and $HNO_3$ are added, and the composition for surface treatment has a Zr concentration of 0.2 mmol/L, Ca concentration of 10 ppm, Cu concentration of 1 ppm and $HNO_3$ concentration of 6000 ppm.

After degreasing, a test plate is rinsed by water and kept into said treating solution adjusted to a pH of 5.0 using an ammonium aqueous solution, maintaining the temperature at 70° C. for 60 sec.

Example 6

The composition for surface treatment is prepared with an aqueous solution of hexafluoro zirconic acid (IV) and $NH_4HF_2$ reagent. The molarity ratio of Zr to HF is 7.0 and the Zr concentration is 5.0 mmol/L. The obtained composition is diluted by water and $Ca(NO_3)_2$ reagent, $Mg(NO_3)_2$, $Zn(NO_3)_2$ reagent and $HNO_3$ are added, and the treating solution for surface treatment has a Zr concentration of 1.0 mmol/L, Ca concentration of 1 ppm, Mg concentration of 2000 ppm, Zn concentration of 1000 ppm and $HNO_3$ concentration of 20000 ppm.

After degreasing, a test plate is rinsed by water and soaked in said treating solution for surface treatment adjusted to a pH of 4.0 using an ammonium aqueous solution, maintaining the temperature at 45° C. for 90 seconds.

Example 7

The composition for surface treatment is prepared with an aqueous solution of hexafluoro zirconic acid (IV) and hydrofluoric acid. The molarity ratio of Zr to HF is 7.0 and Zr concentration is 50 mmol/L. The obtained composition is diluted by water and $Ca(SO_3)_2$ reagent, $Sr(NO_3)_2$ reagent, $Cu(NO_3)_2$ reagent, $H_2MoO_4$ reagent, 35%-$H_2O_2$ aqueous solution and $HNO_3$ are added, and the treating solution for surface treatment has a Zr concentration of 1.0 mmol/L, Ca concentration of 1 ppm, Mg concentration of 2000 ppm, Zn concentration of 30 mmol/L, Ca concentration of 150 ppm, Sr concentration of 300 ppm, Cu concentration of 2 ppm, $H_2MoO_4$ concentration of 1000 ppm, $H_2O_2$ concentration of 10 ppm, and $HNO_3$ concentration of 30000 ppm.

After degreasing, a test plate is rinsed by water and said treating solution for surface treatment adjusted to pH 6.0 by NaOH and, maintaining the temperature at 50° C., sprayed and the surface treatment is carried out for 60 sec.

Example 8

The composition for surface treatment is prepared with an aqueous solution of hexafluoro titanium (IV) and $NaHF_2$ reagent. The molarity ratio of Ti to HF in the composition is 7.0 and the Ti concentration is 20.0 mmol/L. Then, $Sr(NO_3)_2$ reagent, $Zn(NO_3)_2$ reagent, $H_2MoO_4$ reagent, $HVO_3$ reagent and $HNO_3$ are added, and the treating solution for surface treatment has a Ti concentration of 5 mmol/L, Sr concentration of 100 ppm, Zn concentration of 5000 ppm, $H_2MoO_4$ concentration of 15 mmol/L, $HVO_3$ concentration of 50 ppm and $HNO_3$ concentration of 10000 ppm.

After degreasing, a test plate is rinsed by water and kept in said treating solution for surface treatment adjusted to a pH of 3.0 using an ammonium aqueous solution, maintaining the temperature at 50° C. and for 90 sec.

Comparative Example 1

A treating solution containing hafnium oxide and hydrofluoric acid in which the molarity ratio of Hf to HF is 20.0 and the HF concentration is 20 mml/L is prepared. After degreasing, a test plate is rinsed by water and kept in said treating solution for surface treatment adjusted to a pH of 3.7 using an ammonium aqueous solution, maintaining the temperature at 40° C. and the surface treatment is carried out for 120 sec.

Comparative Example 2

A treating solution containing zirconium nitrate (IV) and $NH_4HF_2$ reagent in which the molarity ratio of Zr to HF is 10.0 and Zr concentration is 0.03 mml/L is prepared. After degreasing, a test plate is rinsed by water and kept in said treating solution for surface treatment heated to 50° C. to which a corresponding amount of $Ba(NO_3)_2$ reagent to 10 ppm of Ba, corresponding to the amount of $Mn(NO_3)_2$ reagent to 1 ppm of Mn, and further adjusted to a pH of 5.0 using an ammonium aqueous solution and the surface treatment is carried out for 60 seconds.

Comparative Example 3

ALCHROM 713 (T.M.: product of NIHON PARKERIZING CO., LTD.), a chromic chromate treating agent, is diluted to 3.6% by tap water, then the total acidity and free acidity of the prepared solution are adjusted to the center value indicated in a brochure. After degreasing, a test plate is rinsed by water and soaked in said chromate treating solution at 35° C. and kept for 60 seconds.

Comparative Example 4

PALCOAT 3756 (T.M.: product of NIHON PARKERIZING CO., LTD.), a chromic chromate treating agent, is diluted to 2% by tap water, then the total acidity and free acidity of the prepared solution are adjusted to the center value indicated in a brochure. After degreasing, a test plate is rinsed by water and is soaked in said chromate treating solution at 40° C. and kept for 60 seconds.

Comparative Example 5

A solution of PREPALENE ZTH (T.M.: product of NIHON PARKERIZING CO., LTD.), zinc phosphate treatment, is prepared with dilution to 0.14% by tap water. This solution is sprayed onto said test plate rinsed by tap water after degreasing at room temperature for 30 sec. Then, the test plate is kept in a treating solution of zinc phosphate at 42° C., which is prepared by diluting PALBOND L3080 (T.M.: product of NIHON PARKERIZING CO., LTD.) to 4.8% with tap water by adding 300 ppm of $NaHF_2$ reagent as HF to adjust the total acidity and the free acidity to the center value indicated in a brochure. After this procedure the zinc phosphate film is formed on the test plate.

The prepared test plates in the above-mentioned Examples and Comparative Examples are tested and evaluated according to the following test procedures, that is, an evaluation of the surface appearance, amount of treated film, corrosion resistance of the treated film and the performance on a treated plate.

Surface Appearance of Treated Film

The appearance of the surface-treated plate obtained in the Examples and Comparative Examples are visually inspected. The results of the evaluation of the surface-treated film are summarized in Table 1.

TABLE 1

| | Appearance after surface treatment | | |
|---|---|---|---|
| | ADC | Al | Mg |
| Example 1 | U.W.C. | U.W.C. | U.W.C. |
| Example 2 | U.W.C. | U.W.C. | U.W.C. |
| Example 3 | U.W.C. | U.W.C. | U.W.C. |
| Example 4 | U.W.C. | U.W.C. | U.W.C. |
| Example 5 | U.W.C. | U.W.C. | U.W.C. |
| Example 6 | U.W.C. | U.W.C. | U.W.C. |
| Example 7 | U.W.C. | U.W.C. | U.W.C. |

TABLE 1-continued

| | Appearance after surface treatment | | |
|---|---|---|---|
| | ADC | Al | Mg |
| Example 8 | U.W.C. | U.W.C. | U.W.C. |
| Comp. Example 1 | White, uneven | White, uneven | White, uneven |
| Comp. Example 2 | Uneven | Uneven | Uneven |
| Comp. Example 3 | G.C. | G.C. | G.C. |
| Comp. Example 4 | W.C.U. | W.C.U. | White, uneven |
| Comp. Example 5 | White, uneven | White, uneven | White, uneven |

In table 1, the meaning of each abbreviated codes are indicated as follows;
U.W.C.: uniform white color,
G.C.: golden color
W.C.U.: white color uniform Results of the test plates prepared in each Example show that uniform films are formed. On the other hand, in the cases of the Comparative Examples, an uniform film can not be formed on all test plates except Comparative Example 3 using chromate treatment.

Amount of Surface-Treated Film Layer

The amount of the surface treated film layer of the surface-treated plates obtained in the above-mentioned Examples and Comparative Examples 1 and 2 are evaluated with an X-ray fluorescence analyzer (product of Rigaku Electric Industries: system 3270) by analyzing quantitatively the elements contained in the treated film. The results are summarized in Table 2.

TABLE 2

| | Deposit weight per unit of surface treated film layer (total amount of Ti, Zr, Hf and Si: mg/m$^2$) | | |
|---|---|---|---|
| | ADC | Al | Mg |
| Example 1 | 33 | 27 | 25 |
| Example 2 | 49 | 39 | 33 |
| Example 3 | 40 | 34 | 31 |
| Example 4 | 72 | 51 | 46 |
| Example 5 | 31 | 23 | 18 |
| Example 6 | 55 | 42 | 36 |
| Example 7 | 52 | 45 | 41 |
| Example 8 | 15 | 11 | 10 |
| Comp. Example 1 | 9 | 6 | 5 |
| Comp. Example 2 | 6 | 5 | 3 |

As shown in Table 2, in all cases of Example, the aimed deposit weight per unit of treated film can be obtained. While, in Comparative Examples 1 and 2, the deposit weight per unit is not attained to the aimed value.

As shown in Table 2, in all the cases of the Examples, the aimed deposit weight per unit of treated film can be obtained. While, in Comparative Examples 1 and 2, the deposit weight per unit is not attained to the aimed value.

Evaluation of Coating Performance (1) Preparation of Test Plate

For the purpose of evaluating the coating performance of the surface-treated plates obtained in Examples and Comparative Examples, coating is carried out by the following procedure.

cathodic electrodeposition coating→rinsing by pure water→baking→surfacer→baking→top coating→baking cathodic electrodeposition coating: epoxy type cathodic electrodeposition coating (GT-10LF: product of KANSAI PAINT CO., LTD.), electric voltage is 200V, thickness of film is 20 μm, baked at 175° C. for 20 minutes.

surfacer: aminoalkyd coating (TP-65 white: product of KANSAI PAINT CO., LTD.), spray coating, thickness of film is 35 μm, baked at 140° C. for 20 minutes.

top coating: aminoalkyd coating (NEOAMILAC-6000 white: product of KANSAI PAINT CO., LTD.), spray coating, thickness of film is 35 μm, baked at 140° C. for 20 minutes.

(2) Evaluation of Coating Performance

The coating performance of the surface-coated plates having surfaces coated by the above-mentioned process are evaluated. Evaluation items, evaluation method and abbreviation marks are shown below. Hereinafter, the coated film after electrodeposition coating process is called "electrodeposition coated film" and the coated film after top coating is called "3 coats coated film".

SST: salt spray test (electrodeposition coated film, and corrosion resistance after surface treatment without coating.)

The electrodeposition coated plate having cross-cut lines with a sharpened knife is sprayed aqueous solution of 5%-NaCl for 840 hours (in accordance with JIS-Z-2371). After the test periods, the maximum blistering width from both sides of the cross-cut line is measured. While, corrosion resistance is measured by evaluating the white stain generated area (%) after 48 hrs. of a salt water spray without marking the cross-cut line by visual inspection.

SDT: hot salt water dipping test (electrodeposition coated film)

An electrodeposition coated plate having cross-cut lines are marked by a sharpened knife is immersed into an aqueous solution of 5%-NaCl at the temperature of 50° C. for 240 hours. After a test period, rinsed by city water and dried in room temperature, the cross-cut part of the electrodeposition coated film is peeled using an adhesive tape, and the maximum peeled width from both sides of the cross-cut part is measured.

1st ADH: primary adhesiveness (3 coats coated film, before immersion test)

100 cross hatches of 2 mm width are marked using a sharpened knife on a 3 coats coated film. The cross hatches are peeled using an adhesive tape, and the numbers of peeled hatches are counted.

2nd ADH: water-resistant secondary adhesiveness (3 coats coated film, after immersion test)

A 3 coats coated film is immersed in pure water at 40° C. for 240 hours. After immersion, 100 cross hatches of 2 mm width are marked using a sharpened knife on it. The cross hatches part is peeled using an adhesive tape, and the numbers of peeled checker mark are counted.

The evaluation results of the coating performance and corrosion resistance of the treated material without coating are summarized in Table 3.

TABLE 3

| | Coating performance of electrodeposition | | | | | | Corrosion resistance of uncoated metal | | |
|---|---|---|---|---|---|---|---|---|---|
| | SST: max. blistering width from both side (mm) | | | SDT: max. peeled width from both side (mm) | | | SST: white stain generated area (%) | | |
| | Al | ADC | Mg | Al | ADC | Mg | Al | ADC | Mg |
| Example 1 | 0.3 | 1.1 | 2.5 | 0.5 | 1.6 | 3.2 | 5 | 5 | 10 |
| Example 2 | 0.6 | 1.2 | 2.7 | 0.6 | 1.7 | 3.3 | 5 | 5 | 10 |
| Example 3 | 0.4 | 1.2 | 2.6 | 0.7 | 1.5 | 3.0 | 5 | 5 | 10 |
| Example 4 | 0.5 | 1.3 | 2.6 | 0.5 | 1.2 | 3.1 | 5 | 5 | 10 |

TABLE 3-continued

| | Coating performance of electrodeposition | | | | | | Corrosion resistance of uncoated metal | | |
|---|---|---|---|---|---|---|---|---|---|
| | SST: max. blistering width from both side (mm) | | | SDT: max. peeled width from both side (mm) | | | SST: white stain generated area (%) | | |
| | Al | ADC | Mg | Al | ADC | Mg | Al | ADC | Mg |
| Example 5 | 0.5 | 1.5 | 2.5 | 0.5 | 1.3 | 3.1 | 5 | 5 | 10 |
| Example 6 | 0.5 | 1.0 | 2.8 | 0.5 | 1.4 | 3.0 | 5 | 5 | 10 |
| Example 7 | 0.3 | 1.2 | 2.6 | 0.5 | 1.5 | 3.3 | 5 | 5 | 10 |
| Example 8 | 0.5 | 1.3 | 2.6 | 0.5 | 1.4 | 3.4 | 5 | 5 | 10 |
| Comp. Example 1 | 0.6 | 2.1 | 3.5 | 1.0 | 2.0 | 5.0 | 30 | 30 | 40 |
| Comp. Example 2 | 1.5 | 2.8 | 4.0 | 2.2 | 2.3 | 5.2 | 40 | 50 | 50 |
| Comp. Example 3 | 0.5 | 1.2 | 2.6 | 0.3 | 1.5 | 3.1 | 5 | 5 | 10 |
| Comp. Example 4 | 0.6 | 2.0 | 3.2 | 0.8 | 2.1 | 6.8 | 40 | 60 | 70 |
| Comp. Example 5 | 0.5 | 2.2 | 10< | 1.2 | 2.5 | 10< | 50 | 70 | 80 |

It is obvious from Table 3 that all the test plates of the Examples had a good corrosive resistance. On the other hand, in Comparative Example 1, although the treating composition has the molarity ratio Ti to HF of 20.0, neither the alkaline earth metal ion B of the component (3) nor metal ion C of the component (4) causes the treated film unsound. Consequently, the corrosion resistance of the coated plates is inferior to the test plates of the Examples. In Comparative Example 2, a sufficient amount of film cannot be obtained to provide a good corrosion resistance to the uncoated test plate, because the concentration of Zr, which is the main component of the treated film before coating, is small, 0.03 mmol/L.

Since the Comparative Example 3 is a chromate treating agent, it provides an excellent resistance to corrosion to aluminum and magnesium. Furthermore, since Comparative Example 4 is a chromium-free treating agent for an aluminum alloy, the corrosion resistance of aluminum is inferior to that of Comparative Example 3. While the Examples are chromium-free, they show a similar ability to chromate in all items. Comparative Example 5 is a zinc phosphate treatment for aluminum simultaneous treatment which is ordinarily used as the base coating for cathodic electrodeposition coating. Therefore, the resistance to corrosion of aluminum is practically good. As shown in Comparative Example 5, the corrosion resistance of the Mg alloy is inferior to that of Examples, especially, regarding the corrosion resistance of a Mg alloy without coating, it can be said that it does not attain the desired level in practical use.

The evaluation results of the adhesiveness of 3 coats plates are shown in Table 4. Examples 1-8 shows good adhesiveness to all test plates.

TABLE 4

| | Coating adhesiveness of 3 coats coated film | | | | | |
|---|---|---|---|---|---|---|
| | 1st ADH | | | 2nd ADH | | |
| | Al | ADC | Mg | Al | ADC | Mg |
| Example 1 | 0 | 0 | 0 | 0 | 0 | 0 |
| Example 2 | 0 | 0 | 0 | 0 | 0 | 0 |
| Example 3 | 0 | 0 | 0 | 0 | 0 | 0 |
| Example 4 | 0 | 0 | 0 | 0 | 0 | 0 |
| Example 5 | 0 | 0 | 0 | 0 | 0 | 0 |

TABLE 4-continued

| | Coating adhesiveness of 3 coats coated film | | | | | |
|---|---|---|---|---|---|---|
| | 1st ADH | | | 2nd ADH | | |
| | Al | ADC | Mg | Al | ADC | Mg |
| Example 6 | 0 | 0 | 0 | 0 | 0 | 0 |
| Example 7 | 0 | 0 | 0 | 0 | 0 | 0 |
| Example 8 | 0 | 0 | 0 | 0 | 0 | 0 |
| Comp. Example 1 | 0 | 0 | 0 | 0 | 0 | 0 |
| Comp. Example 2 | 0 | 0 | 0 | 5 | 5 | 8 |
| Comp. Example 3 | 0 | 0 | 0 | 0 | 0 | 0 |
| Comp. Example 4 | 0 | 0 | 0 | 0 | 5 | 0 |
| Comp. Example 5 | 0 | 0 | 0 | 0 | 0 | 0 |

According to the above-mentioned results, it is obvious that the treating solution for metal surface treatment, method for surface treatment solution and surface-treated metal material of the present invention, can provide a metal material with a film which has excellent corrosion resistance, either uncoated or coated, of aluminum, an aluminum alloy, magnesium or a magnesium alloy.

Further, in Comparative Example 5, sludge which is the by-product at the zinc phosphate treatment, is generated in the treatment, but, after treatment in the inventive process, the generation of sludge is not observed in any Example.

INDUSTRIAL APPLICABILITY

The treating solution for metal surface treatment and the method for surface treatment using the present inventive composition is an epoch-making art which makes it possible to form a surface-treated film having good corrosion resistance of metals without coating and corrosion resistance after coating on the surface of aluminum, an aluminum alloy, magnesium or a magnesium alloy without generating waste such as sludge and using a treating solution not containing a harmful component to the environment, such as hexavalent chrome.

Since the metal material for surface treatment has an excellent corrosion resistance to various environments and corrosion resistance after coating, it can be used in various fields. Furthermore, the present invention enables the shortening of the treatment procedure and saving of operating space, because the zinc phosphate treating process usually used is not needed.

What is claimed is:

1. A method for pretreatment of a metal material containing at least one metal selected from the group consisting of aluminum, aluminum alloys, magnesium and magnesium alloys comprising the steps of:

providing a treating solution for surface treatment comprising components (1) to (6), (1) 0.1 to 50 mmol/L of a compound A containing at least one metal selected from the group consisting of Hf(IV), Ti(IV) and Zr(IV) as said metal contained in compound A, (2) a fluorine-containing compound of a sufficient amount to cause etching of the surface of the aluminum, aluminum alloys, magnesium or magnesium alloys and to make fluorine exist in the treating solution in an amount of at least 7 times the molarity of the total molarity of the metal contained in compound A, (3) at least one metal ion B selected from the group consisting of Ca, Sr and Ba, (4) at least one metal ion C selected from the group consisting of Zn, Mg, Mn and Cu, (5) nitric ion, and (6) at least one compound selected from the group consisting of $HClO_3$, $HBrO_3$, $HNO_2$, $HMnO_4$, $HVO_3$, $H_2WO_4$, and an oxygen acid salt thereof;

contacting a surface of the metal material with the treating solution for no more than 180 seconds, the treating solution having a pH of from 3 to 6, a temperature of from 30-70° C. and free fluorine ion concentration of less than 500 ppm;

etching the surface of the metal material with the treating solution; and depositing a surface-treated film layer of the metal contained in compound A of from more than 10-72 $mg/m^2$.

2. The method of claim 1, wherein the total concentration of metal ion B is from 1 to 500 ppm.

3. The method of claim 1, wherein the total concentration of metal ion C is from 1 to 5000 ppm.

4. The method of claim 1, wherein the concentration of nitric ion is from 1000 to 30000 ppm.

5. The method of claim 1, wherein the concentration of the at least one compound selected from the group consisting of $HClO_3$, $HBrO_3$, $HNO_2$, $HMnO_4$, $HVO_3$, $H_2WO_4$, and an oxygen and salt thereof, is from 10 to 5000 ppm.

6. The method of claim 1, wherein the treating solution consists essentially of components (1) to (6).

7. The method of claim 1, wherein the treating solution has a pH of from 4 to 6.

8. The method of claim 1, wherein the treating solution has a pH of from 5 to 6.

9. The method of claim 1, wherein the treating solution has a pH of 6.

10. The method of claim 1, wherein component (6) is at least one compound selected from the group consisting of $HMnO_4$, $HVO_3$, $H_2WO_4$, and an oxygen acid salt thereof.

11. The method of claim 1, wherein the concentration of the at least one compound selected from the group consisting of $HClO_3$, $HBrO_3$, $HNO_2$, $HMnO_4$, $HVO_3$, $H_2WO_4$, and an oxygen acid salt thereof, is from 10 to 200 ppm.

* * * * *

UNITED STATES PATENT AND TRADEMARK OFFICE

CERTIFICATE OF CORRECTION

PATENT NO. : 7,819,989 B2
APPLICATION NO. : 10/505640
DATED : October 26, 2010
INVENTOR(S) : Kazuhiro Ishikura et al.

It is certified that error appears in the above-identified patent and that said Letters Patent is hereby corrected as shown below:

On the title page, please change from

"(75) Inventors: Kazuhiro Ishikura, Tokyo (JP);
Michiro Kurosawa, Tokyo (JP);
Takaomi Nakayama, Totyo (JP);
Hiroyuki Sato, Totyo (JP);
Tadashi Matsushita, Totyo (JP);
Eisaku Okada, Toyota (JP);
Fumiya Yoshida, Ikeda (JP);
Katsuhiro Shiota, Ikeda (JP)"

to

--(75) Inventors: Kazuhiro Ishikura, Tokyo (JP);
Michiro Kurosawa, Tokyo (JP);
Takaomi Nakayama, Tokyo (JP);
Hiroyuki Sato, Tokyo (JP);
Tadashi Matsushita, Tokyo (JP);
Eisaku Okada, Toyota (JP);
Fumiya Yoshida, Ikeda (JP);
Katsuhiro Shiota, Ikeda (JP)--

Signed and Sealed this
Twenty-second Day of February, 2011

David J. Kappos

David J. Kappos
*Director of the United States Patent and Trademark Office*